US011457515B2

(12) United States Patent
Lim et al.

(10) Patent No.: US 11,457,515 B2
(45) Date of Patent: Sep. 27, 2022

(54) HYBRID COOKING APPLIANCE WITH MICROWAVE AND INDUCTION HEATING FEATURES

(71) Applicant: Haier US Appliance Solutions, Inc., Wilmington, DE (US)

(72) Inventors: Tae-Hoon Lim, Seongnam (KR); Dong Soo Shin, Seongnam (KR); Hyuk-chul Kwon, Seongnam (KR); Byung Cheon Lee, Seongnam (KR); Ju Chan Park, Seongnam (KR); Jaebong Lee, Seongnam (KR); Youngjin Oh, Seongnam (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 435 days.

(21) Appl. No.: 16/750,215

(22) Filed: Jan. 23, 2020

(65) Prior Publication Data

US 2021/0235555 A1 Jul. 29, 2021

(51) Int. Cl.
*H05B 6/64* (2006.01)
*H05B 6/12* (2006.01)
*H05B 6/76* (2006.01)

(52) U.S. Cl.
CPC ..... *H05B 6/6488* (2013.01); *H05B 6/1209* (2013.01); *H05B 6/6402* (2013.01); (Continued)

(58) Field of Classification Search
CPC ..... H05B 2206/02; H05B 2206/04; H05B 6/1209; H05B 6/6402; H05B 6/6408; H05B 6/6411; H05B 6/642; H05B 6/647; H05B 6/6473; H05B 6/6488; H05B 6/76
USPC ..... 219/601, 625, 626, 627, 704, 705, 715, 219/716, 720, 725, 726, 727, 736, 738, 219/740, 742, 743
See application file for complete search history.

(56) References Cited

U.S. PATENT DOCUMENTS 5,110,651 A * 5/1992 Massard ..... H01Q 15/24 428/113
5,177,333 A 1/1993 Ogasawara
(Continued)

FOREIGN PATENT DOCUMENTS

CN 104089310 A 10/2014
JP H8138864 A 5/1996
JP 22734959 A 8/1996

*Primary Examiner* — Quang T Van
(74) *Attorney, Agent, or Firm* — Dority & Manning, P.A.

(57) ABSTRACT

A cooking appliance, as provided herein, may include a cabinet, a magnetron, an induction heating coil, and a one-way field filter. The cabinet may define a cooking chamber. The magnetron may be mounted within the cabinet in communication with the cooking chamber to direct a microwave thereto. The induction heating coil may be mounted within the cabinet to direct a magnetic field thereto. The one-way field filter may be disposed within the cabinet between the induction heating coil and the cooking chamber to restrict passage of the microwave therethrough while permitting the magnetic field. The one-way filter may include a lower layer and an upper layer. The lower layer may include a plurality of parallel conductive bands extending in a first direction. The upper layer may be disposed above the lower layer. The upper layer may include a plurality of parallel conductive bands extending in the second direction.

20 Claims, 8 Drawing Sheets

(52) U.S. Cl.
CPC ..... *H05B 6/642* (2013.01); *H05B 6/6411* (2013.01); *H05B 6/6473* (2013.01); *H05B 6/76* (2013.01); *H05B 2206/02* (2013.01); *H05B 2206/04* (2013.01)

(56) References Cited

U.S. PATENT DOCUMENTS 5,334,800 A * 8/1994 Kenney ..... H05K 1/0224 174/250
5,548,101 A 8/1996 Lee
5,698,125 A 12/1997 Kwon
6,147,336 A * 11/2000 Ushijima ..... H05B 6/6485 219/699

* cited by examiner

HYBRID COOKING APPLIANCE WITH MICROWAVE AND INDUCTION HEATING FEATURES

FIELD OF THE INVENTION

The present subject matter relates generally to cooking appliances, and more particularly to cooking appliances having features for microwave and induction heating in a common cavity.

BACKGROUND OF THE INVENTION

Over the past several decades, microwave cooking appliances (i.e., microwave appliances) have become a staple appliance for many, if not most kitchens. Generally, microwave appliances include a cabinet that defines a cooking chamber for receipt of food items for cooking. In order to provide selective access to the cooking chamber and to contain food items and cooking energy (e.g., microwaves) during a cooking operation, a door is further included that is typically pivotally mounted to the cabinet. During use, a magnetron can generate the microwave radiation or microwaves that are directed specifically to the cooking chamber. The microwave radiation is typically able to heat and cook food items within the cooking chamber faster than would be possible with conventional cooking methods using direct or indirect heating methods. Moreover, since microwave appliances are often smaller than other appliances (e.g., a conventional baking oven) within a kitchen, microwave appliances are often preferable for heating relatively small portions or amounts of food.

In spite of the advantages provided by typical microwave appliances, there can be instances where other cooking methods are preferable (e.g., separate from or in addition to microwave cooking in order to slowly or evenly heat a specific food item). Induction cooking, for example, is especially popular since it offers certain safety benefits. Generally, for induction cooking, an induction coil produces a high frequency magnetic field, which can cause eddy currents to flow through a cooking vessel made of steel or stainless steel, and thereby heats the foods by the Joule heat produced in the cooking vessel.

Previous attempts have been made to incorporate an induction coil within the same structure as a magnetron or microwave appliance. Nonetheless, such attempts have largely been unable to adequately shield the induction coil from microwave radiation or microwaves while still permitting a magnetic field at a suitable strength from the induction coil.

As a result, it would be advantageous to provide an cooking appliance with features for both induction and microwave cooking in which the induction cooking features are adequately shielded from microwave radiation.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking appliance is provided. The cooking appliance may include a cabinet, a magnetron, an induction heating coil, and a one-way field filter. The cabinet may define a cooking chamber. The magnetron may be mounted within the cabinet in communication with the cooking chamber to direct a microwave thereto. The induction heating coil may be mounted within the cabinet in communication with the cooking chamber to direct a magnetic field thereto. The one-way field filter may be disposed within the cabinet between the induction heating coil and the cooking chamber to restrict passage of the microwave therethrough while permitting the magnetic field. The one-way filter may include a lower layer and an upper layer. The lower layer may include a plurality of parallel conductive bands extending in a first direction. The plurality of parallel conductive bands of the lower layer may be spaced apart by a set first gap in a second direction perpendicular to the first direction. The first set gap may be greater than 0.2 millimeters. The upper layer may be disposed above the lower layer. The upper layer may include a plurality of parallel conductive bands extending in the second direction. The plurality of conductive bands of the upper layer may be spaced apart by a set second gap in the first direction. The second set gap may be greater than 0.2 millimeters.

In another exemplary aspect of the present disclosure, a cooking appliance is provided. The cooking appliance may include a cabinet, a magnetron, an induction heating coil, and a one-way field filter. The cabinet may define a cooking chamber. The magnetron may be mounted within the cabinet in communication with the cooking chamber to direct a microwave thereto. The induction heating coil may be mounted within the cabinet in communication with the cooking chamber to direct a magnetic field thereto. The one-way field filter may be disposed within the cabinet between the induction heating coil and the cooking chamber to restrict passage of the microwave therethrough while permitting the magnetic field. The one-way filter may include a lower layer and an upper layer. The lower layer may include a plurality of parallel conductive bands extending in a first direction. The plurality of parallel conductive bands of the lower layer may be spaced apart by a set first gap in a second direction perpendicular to the first direction. Each band of the plurality of conductive bands of the lower layer may define a first width in the second direction. The set first gap may be between 10% and 30% of the first width. The upper layer may be disposed above the lower layer. The upper layer may include a plurality of parallel conductive bands may extend in the second direction. The plurality of conductive bands of the upper layer may be spaced apart by a set second gap in the first direction. Each band of the plurality of conductive bands of the upper layer may define a second width in the first direction. The set second gap may be between 10% and 30% of the second width.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
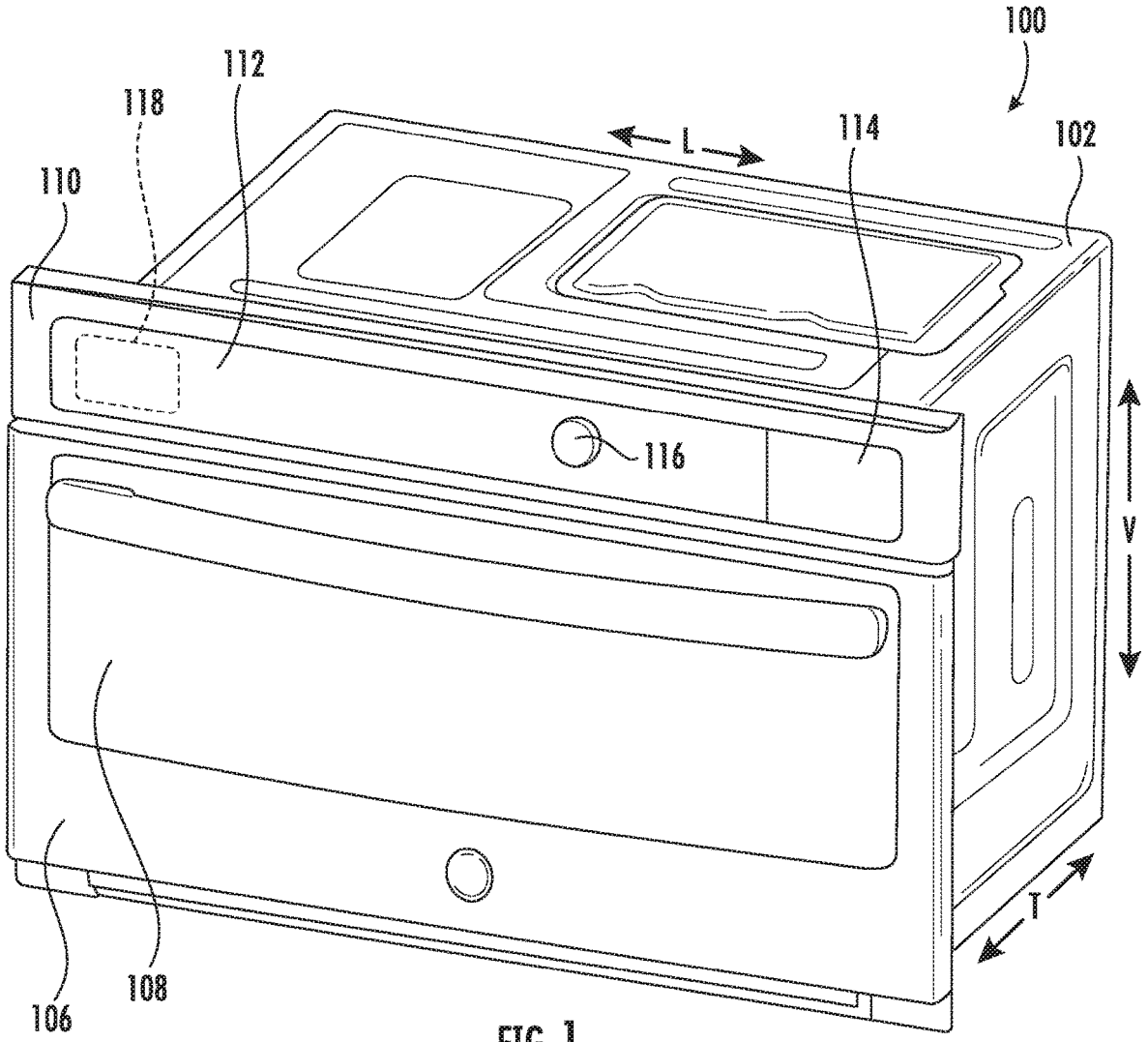
FIG. 1 provides a perspective view of a cooking appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. Furthermore, as used herein, terms of approximation, such as "approximately," "substantially," or "about," refer to being within a ten percent margin of error.

Figure 2:
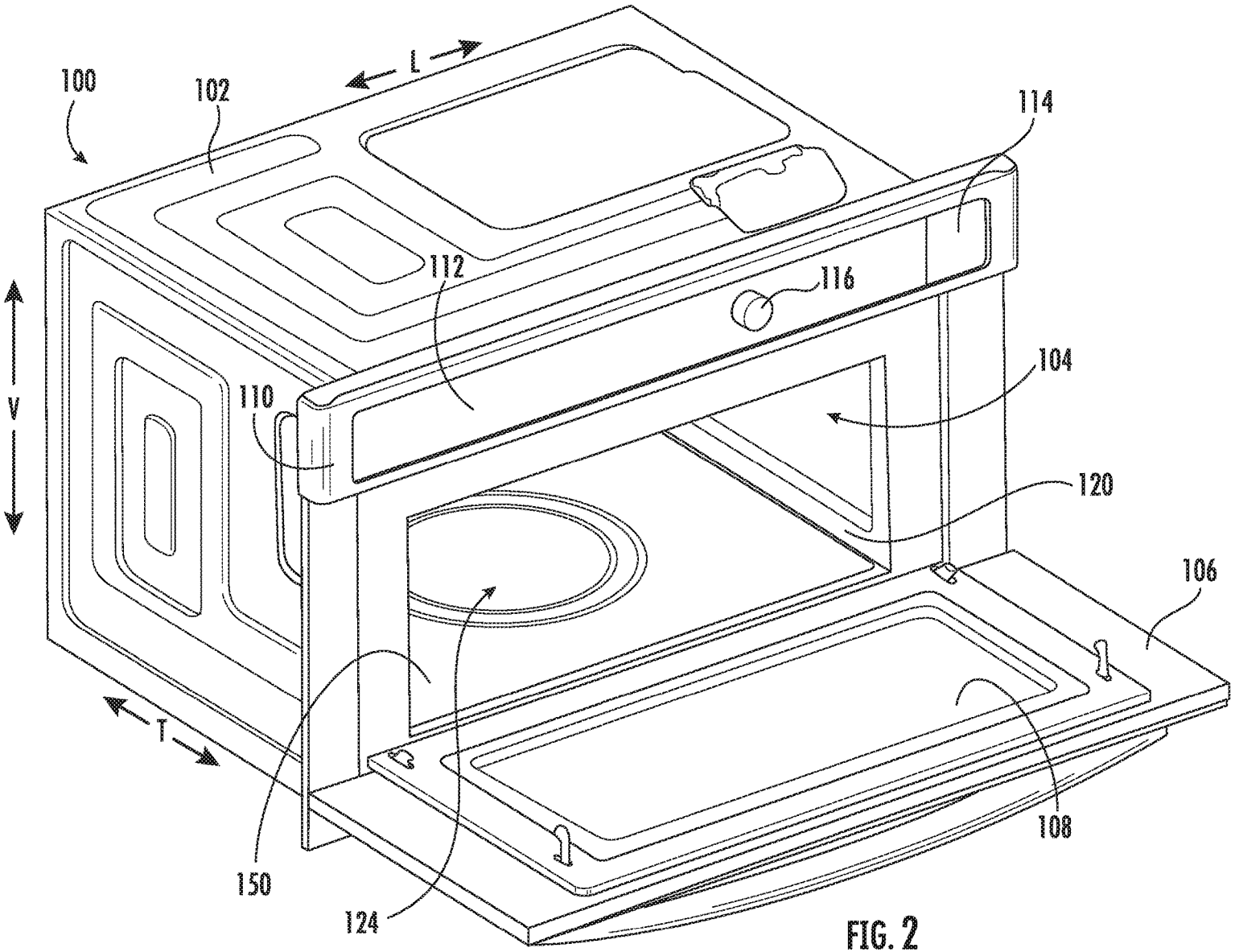
FIG. 2 provides a perspective view of the exemplary cooking appliance of FIG. 1, wherein the door is an open position.
Figure 3:
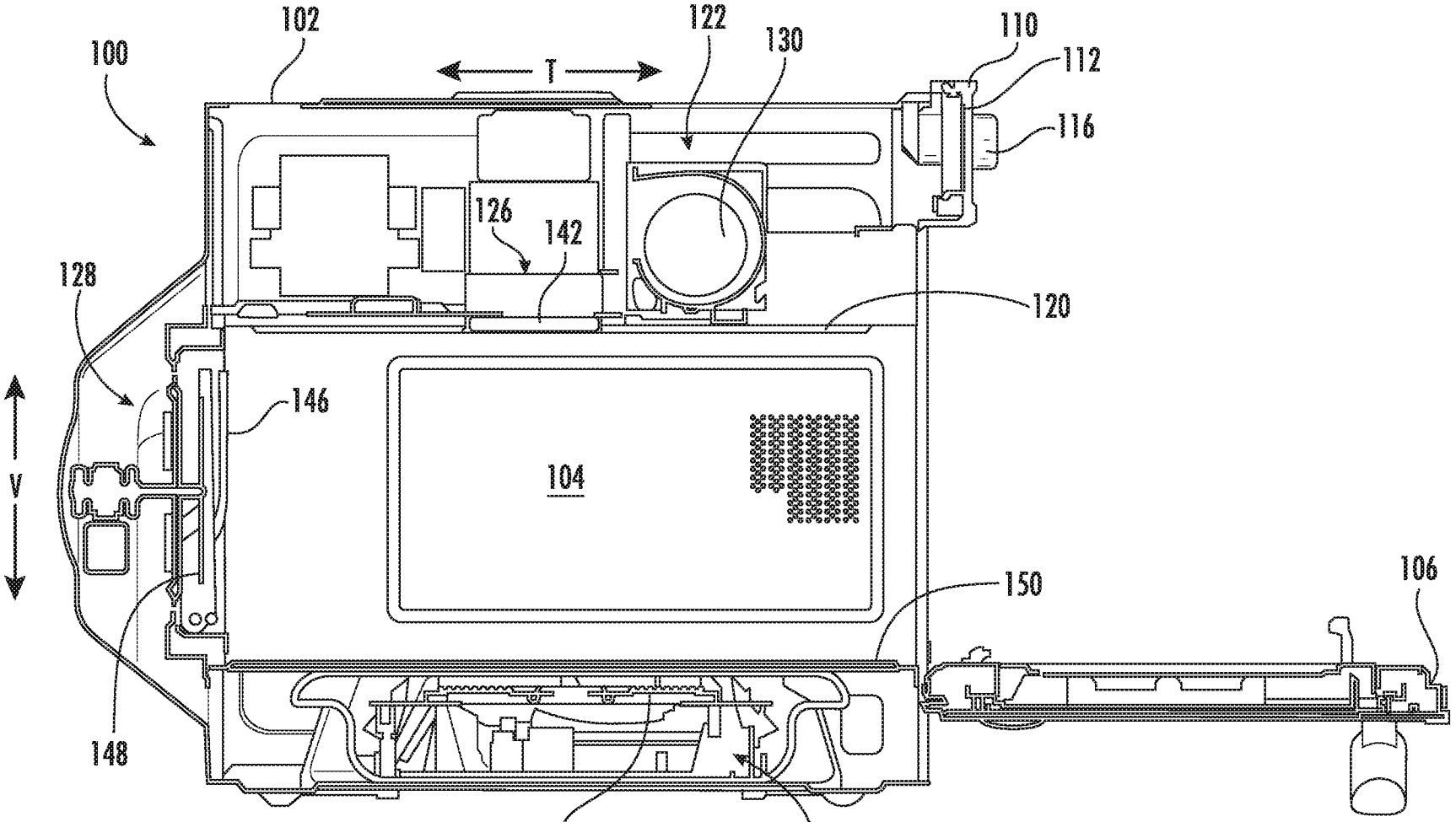
FIG. 3 provides a sectional view of the exemplary cooking appliance of FIG. 2.

Turning now to the figures, FIGS. 1 through 3, various views are provided of a cooking appliance 100 according to exemplary embodiments of the present disclosure. Specifically, FIGS. 1 and 2 provide perspective views of cooking appliance 100 having a door 106 in an open position and a closed position, respectively. FIG. 3 provides a side, sectional view of cooking appliance 100, wherein door 106 is in the open position.

Generally, cooking appliance 100 includes a housing or cabinet 102 that defines a mutually-orthogonal vertical direction V, lateral direction L, and transverse direction T. Within cabinet 102, cooking appliance 100 defines a cooking chamber 104 in which food items can be received. In some embodiments, a door 106 is rotatably mounted to move between the open position and the closed position. As shown, the open position permits access to cooking chamber 104 while the closed position restricts access to cooking chamber 104. A window in door 106 may be provided (e.g., for viewing food items in the cooking chamber 104). Additionally or alternatively, a handle may be secured to door 106 (e.g., to rotate therewith). The handle can be formed of plastic, for example, and can be injection molded.

In certain embodiments, cooking appliance 100 includes a control panel frame 110 on or as part of cabinet 102. A control panel 112 may be mounted within control panel frame 110. Generally, control panel 112 includes a display device 114 for presenting various information to a user. Control panel 112 may also include one or more input devices (e.g., tactile buttons, knobs, touch screens, etc.). In optional embodiments, the input devices of control panel 112 include a knob or dial 116. Selections may be made by rotating dial 116 clockwise or counter-clockwise, and when the desired selection is displayed, pressing dial 116. For example, many meal cook cycles and other cooking algorithms can be preprogrammed in or loaded onto a memory device of a controller 118 of cooking appliance 100 for many different food items types (e.g., pizza, fried chicken, French fries, potatoes, etc.), including simultaneous preparation of a group of food items of different food types comprising an entire meal. Instructions or selections may be displayed on display device 114. In optional embodiments, display device 114 can be used as an input device. For instance, display device 114 may be a touchscreen device, as is understood.

In exemplary embodiments, cabinet 102 of cooking appliance 100 includes an inner shell 120. Inner shell 120 of cabinet 102 delineates the interior volume of cooking chamber 104. Optionally, the walls of shell may be constructed using high reflectivity (e.g., 72% reflectivity) stainless steel.

Cooking appliance 100 includes multiple cooking modules. In particular, cooking appliance 100 includes a microwave module 122 and a lower heater module 124 mounted within cabinet 102. In additional or alternative embodiments, cooking appliance 100 includes an upper heater module 126 or a convection module 128.

Generally, microwave module 122 includes a magnetron 130 mounted within the cabinet 102 (e.g., above cooking chamber 104) and in communication (e.g., fluid or transmissive communication) with the cooking chamber 104 to direct microwave radiation or microwaves thereto. In other words, the microwave module 122 delivers microwave radiation into cooking chamber 104.

Below microwave module 122, lower heater module 124 may be mounted within cabinet 102. For instance, lower heater module 124 may include an induction heating coil 136 mounted below cooking chamber 104. As will be described in greater detail below, induction heating coil 136 may be in communication (e.g., transmissive communication) with cooking chamber 104 (e.g., through a one-way field filter 160) to direction a magnetic field 162 thereto.

Upper heater module 126 can include one or more heating elements 142. For instance, upper heater module 126 can include one or more electric heating elements, such as a resistive heating element (e.g., sheathed resistive heater) or a radiant heating element (e.g., a halogen cooking lamp) in thermal communication with cooking chamber 104. Upper heater module 126 may be mounted within or above cooking chamber 104 or otherwise spaced apart from microwave module 122.

Convection module 128 may include a sheathed heater 146 and a convection fan 148. Convection fan 148 is provided for blowing or otherwise moving air over sheathed heater 146 of convection module 128 and into cooking chamber 104 (e.g., for convection cooking).

The specific heating elements of upper and lower heater modules 126 and 124, convection module 128, and magnetron 130 of microwave module 122 can vary from embodiment to embodiment, and the elements and system described above are exemplary only. For example, the upper heater module 126 or convection module 128 can include any combination of heaters including combinations of halogen lamps, ceramic lamps, or sheathed heaters.

As shown, cooking appliance 100 may include a controller 118. Controller 118 of cooking appliance 100 can include one or more processor(s) and one or more memory device(s). The processor(s) of controller 118 can be any suitable processing device, such as a microprocessor, microcontroller, integrated circuit, or other suitable processing device. The memory device(s) of controller 118 can include any suitable computing system or media, including, but not limited to, non-transitory computer-readable media, RAM, ROM, hard drives, flash drives, or other memory devices. The memory device(s) of controller 118 can store information accessible by the processor(s) of controller 118 including instructions that can be executed by the processor(s) of controller 118 in order to execute various cooking operations or cycles (e.g., a meal cook cycle). Controller 118 is communicatively coupled with various operational components of cooking appliance 100, such as components of microwave module 122, upper heater module 126, lower heater module 124, convection module 128, or control panel 112 (e.g., display device 114 or dial 116), the various control buttons, etc. Input/output ("I/O") signals may be routed between controller 118 and control panel 112 as well as other operational components of cooking appliance 100. Controller 118 can execute and control cooking appliance 100 in various cooking operations or cycles, such as precision cooking, which includes meal cook, microwave, induction, or convection/bake modes.

Figure 4:
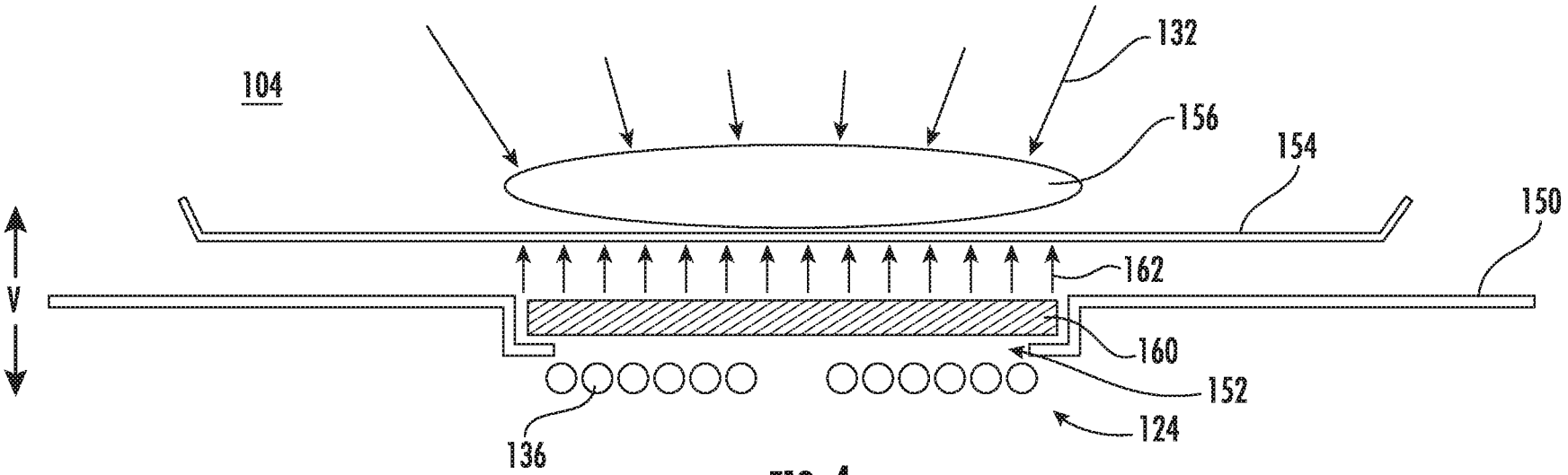
FIG. 4 provides a schematic sectional view of a heating assembly of a cooking appliance according to exemplary embodiments of the present disclosure.

Turning especially to FIG. 4, a schematic sectional view of lower heater module 124 is provided. As shown, induction heating coil 136 may be mounted below cooking chamber 104. In particular, induction heating coil 136 may be mounted beneath a bottom wall 150 of inner shell 120. In some embodiments, a hole or opening 152 is defined through bottom wall 150 (e.g., defining a diameter greater than or equal to a horizontal diameter of induction heating coil 136). Above induction heating coil 136 (e.g., and within cooking chamber 104) a tray or platter 154 may be provided on which a food item 156 may be supported. For induction cooking, the food item 156 may be provided with an induction cooking vessel, as is understood. Controller 118 may be configured to selectively activate induction heating coil 136 to generate a high frequency magnetic field 162, which may be transmitted through opening 152 to the food item 156 thereabove. Moreover, controller 118 may be configured to selectively activate microwave module 122 (FIG. 3) to direct microwaves 132 to food item 156.

In certain embodiments, a one-way field filter 160 is provided between induction heating coil 136 and cooking chamber 104. For instance, one-way field filter 160 may be mounted or disposed across opening 152. As will be described in greater detail below, One-way field filter 160 may limit or restrict passage of microwave radiation or microwaves 132 while significantly and advantageously permitting the magnetic field 162. The magnetic field 162 generated by induction heating coil 136 may thus be forced to pass through one-way field filter 160 before entering cooking chamber 104.

Figure 5:
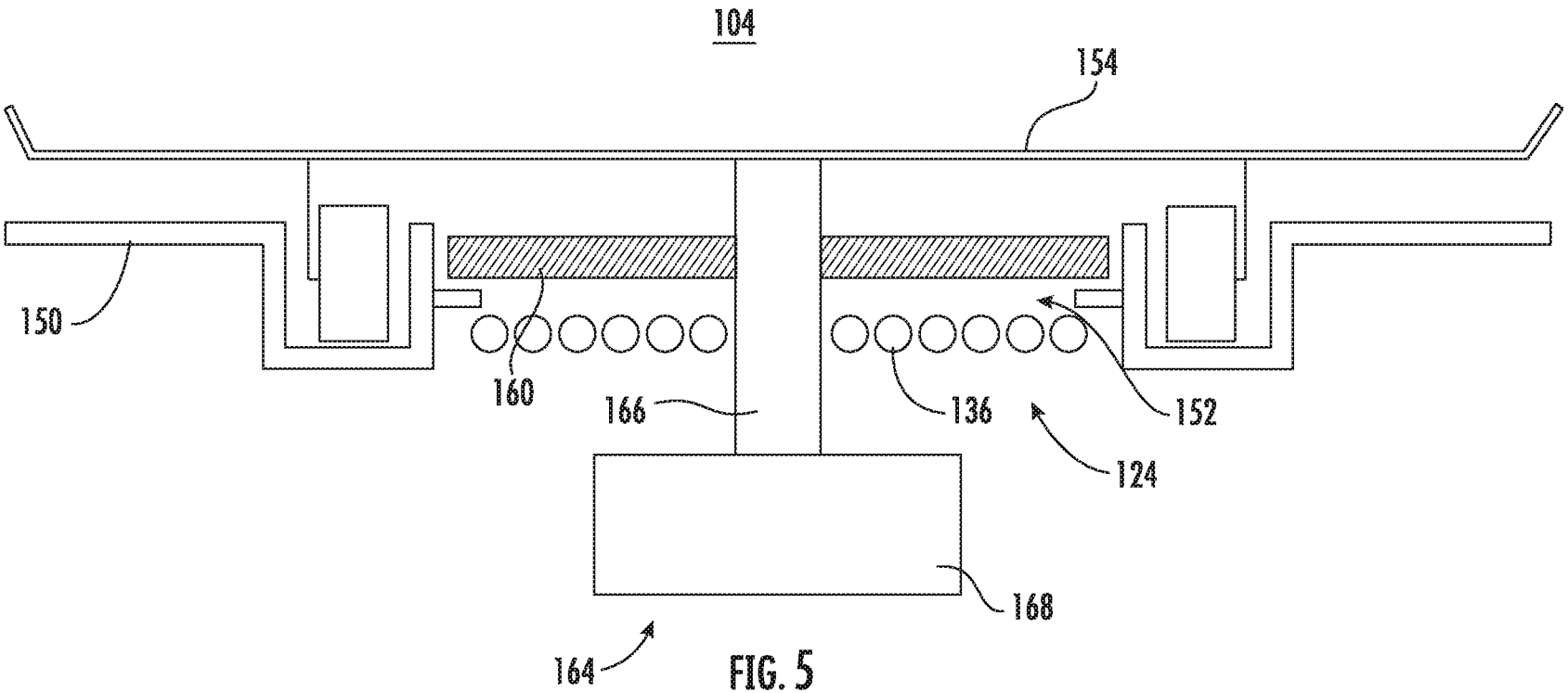
FIG. 5 provides a schematic sectional view of a heating assembly and a turntable assembly of a cooking appliance according to exemplary embodiments of the present disclosure.
Figure 6A:
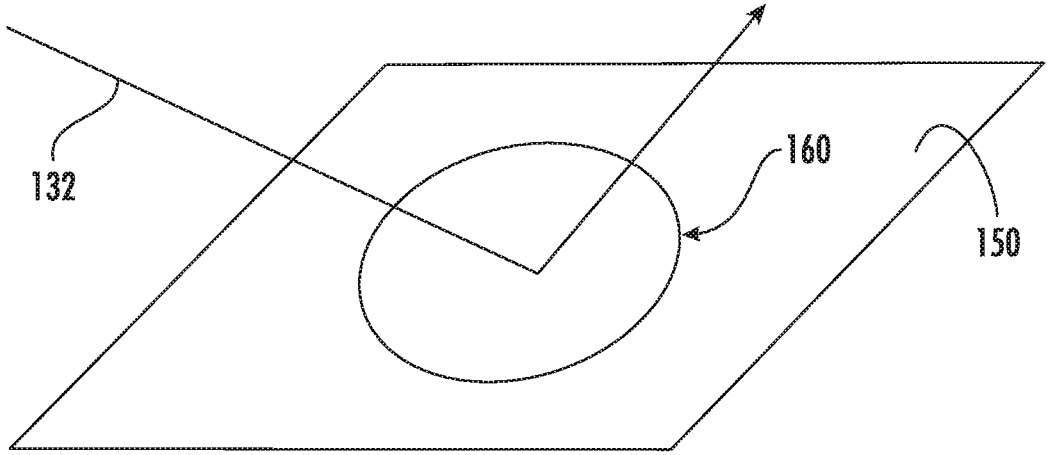
FIG. 6A provides a schematic, perspective view of a one-way field filter of a cooking appliance receiving microwaves according to exemplary embodiments of the present disclosure.
Figure 6B:
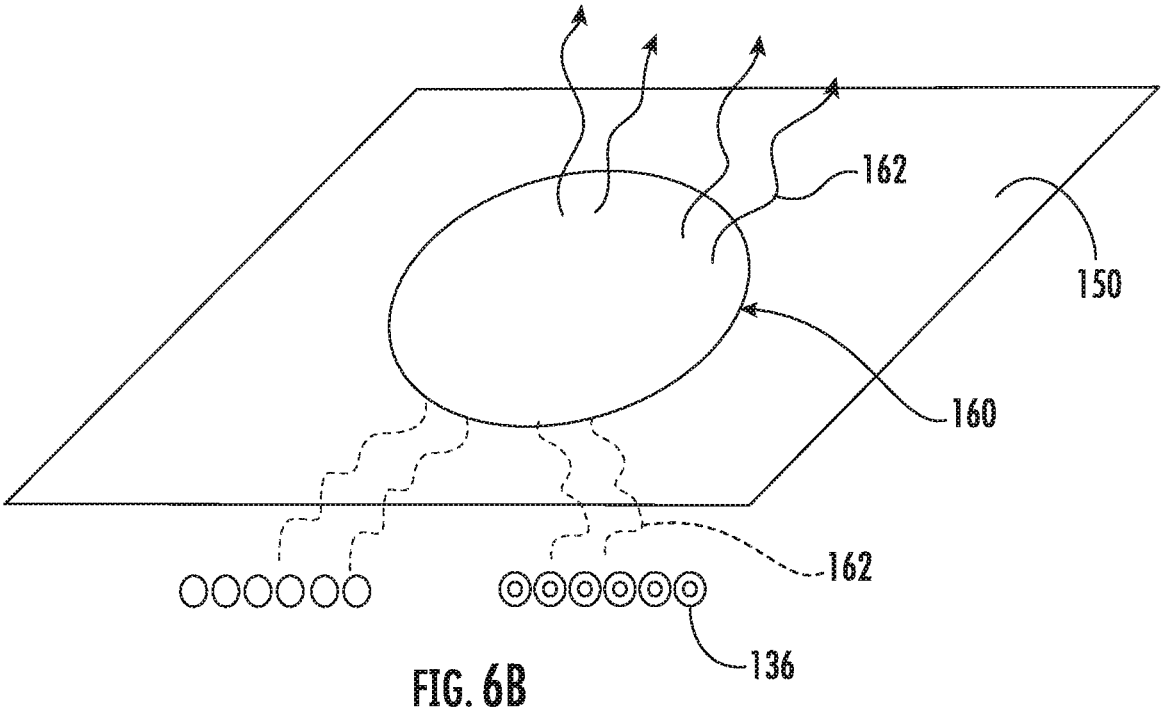
FIG. 6B provides a schematic, perspective view of a one-way field filter of a cooking appliance receiving a magnetic field according to exemplary embodiments of the present disclosure.
Figure 7:
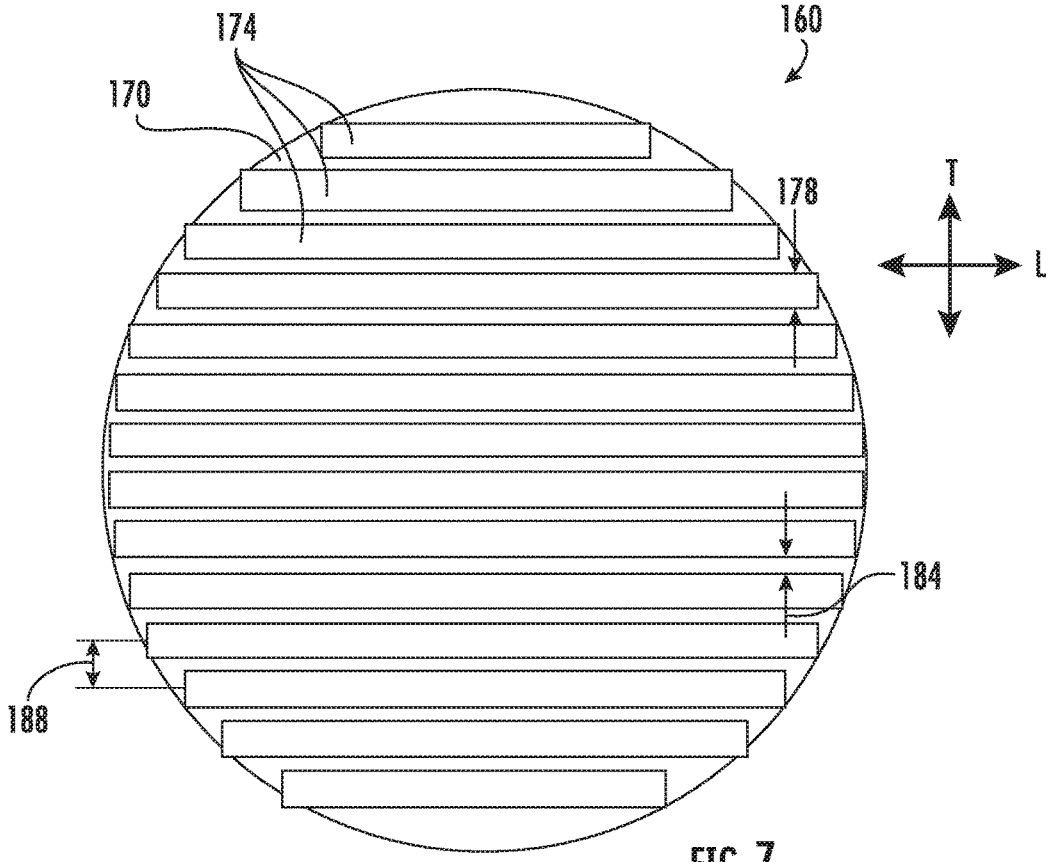
FIG. 7 provides a bottom, perspective view of a one-way field filter of a cooking appliance according to exemplary embodiments of the present disclosure.
Figure 8:
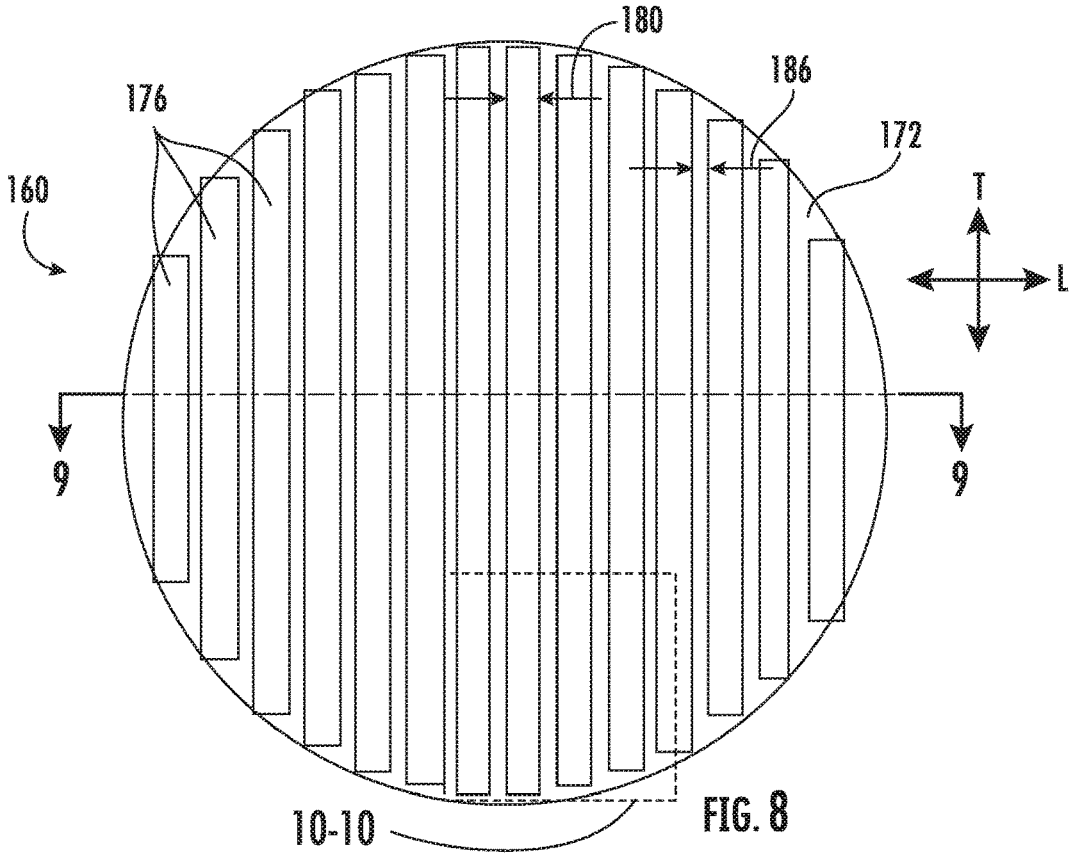
FIG. 8 provides a top, perspective view of the exemplary one-way field filter of FIG. 7
Figure 9:
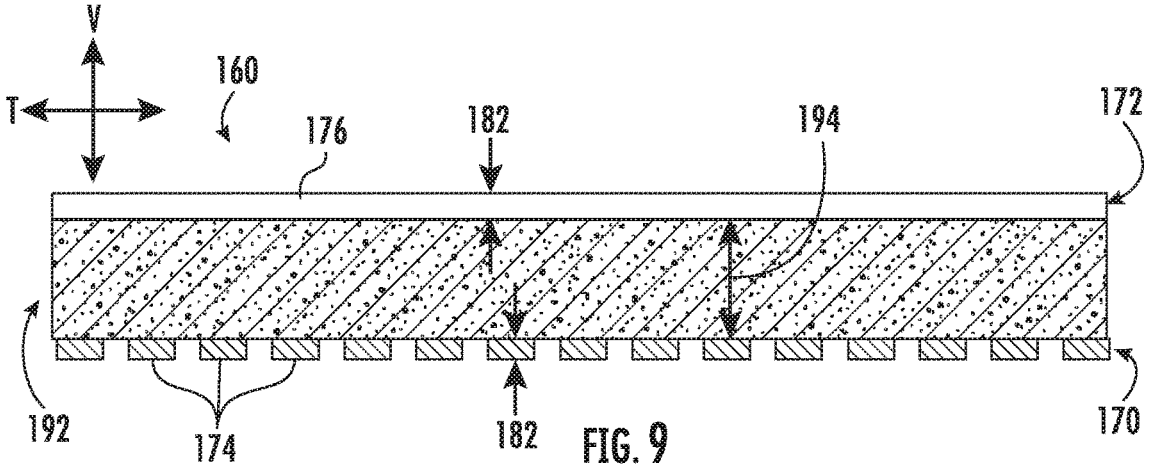
FIG. 9 provides a sectional view of the exemplary one-way field filter of FIG. 8, taken along the lines 9-9.
Figure 10:
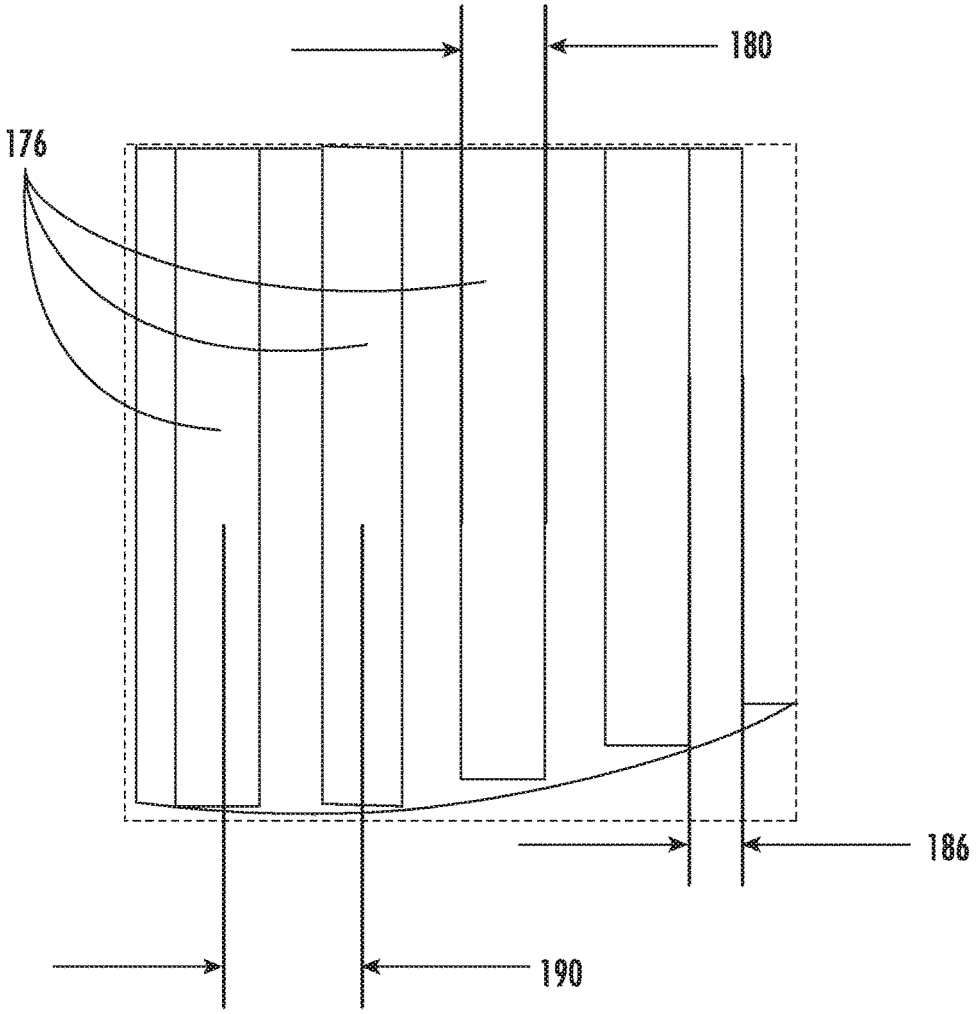
FIG. 10 provides a magnified, sectional view of the exemplary one-way field filter of FIG. 8, within the region 10-10.

Turning briefly to FIG. 5, in optional embodiments, a turntable assembly 164 is further provided within cabinet 102. Generally, the turntable assembly 164 may include a rotatable a rotatable platter 154 driven by a connected drive rod 166 (e.g., as motivated by a separate motor 168). As shown, platter 154 may be positioned above the one-way field filter 160 within cooking chamber 104. Drive rod 166 may extend (e.g., downward) from platter 154. Optionally, drive rod 166 may extend through one-way field filter 160. Drive rod 166 may connect to a turntable motor 168 held below inner shell 120 or one-way field filter 160. Thus, platter 154 may be coupled to motor 168. Turntable motor 168 may be communicatively coupled to controller 118 and may be any suitable motor 168 for providing rotational motivating force to the platter 154. In some exemplary embodiments, the motor 168 may be a stepper motor. The structure and function of motors are generally understood by those of skill in the art and, as such, are not shown or described in further detail herein for the sake of brevity and clarity. Additionally or alternatively, a position switch or sensor, such as a Hall effect sensor, may be provided in platter 154, drive rod 166, or cabinet 102 such that the angular position of the platter 154 may be known (e.g., based on a signal from the position sensor received by the controller 118).

Turning now to FIGS. 6A through 10, various views are provided of one-way field filter 160. As shown, one-way field filter 160 may include multiple layers stacked (e.g., vertically) together. In particular, one-way field filter 160 includes a separate lower layer 170 and upper layer 172, the upper layer 172 being disposed above the lower layer 170. In some embodiments, the lower layer 170 and the upper layer 172 are coaxial, concentric, or otherwise define a common, overlapping perimeter. Thus, lower layer 170 and upper layer 172 may be equal in diameter or horizontal dimensions.

Generally, each layer includes a plurality of conductive bands (e.g., 174 176) that are spaced apart from each other. In particular, each band (e.g., 174 or 176) is formed from a conductive metal (e.g., copper, silver, aluminum, etc.). Each band may further be formed as a flat shape having a minimum horizontal cross-section or width (e.g., 178 or 180) that is greater than a maximum vertical thickness 182.

In some embodiments, the conductive bands 174, 176 of a corresponding layer 170, 172 may be equal or roughly identical in minimum horizontal width 178, 180 or thickness 182. When assembled, the conductive bands 174 or 176 of a corresponding layer 170 or 172 extend in parallel to each other along a common direction (e.g., opposite of the minimum thickness 182). For instance, the conductive bands 174 of the lower layer 170 may extend in a first direction (e.g., transverse direction T) while being spaced apart from each other in an opposite second direction (e.g., lateral direction L) by a first set distance or gap 184. Additionally or alternatively, the conductive bands 176 of the upper layer 172 may extend in the second direction while being spaced apart from each other in the opposite first direction by a second set distance or gap 186. In turn, the layers 170, 172 may be rotationally offset (e.g., by 90° about a central axis or the vertical direction V) such that the conductive bands 174 of lower layer 170 extend in the opposite horizontal direction as the conductive bands 176 of upper layer 172.

Optionally, the spacing 184 or 186 between conductive bands 174 or 176 may be identical. In other words, each conductive band 174 of the lower layer 170 may be spaced apart from the adjacent parallel band(s) 174 by the same first set gap 184 (e.g., which may be greater than 0.2 millimeters or about 0.5 millimeters). Moreover, each conductive band 176 of the upper layer 172 may be spaced apart from the adjacent parallel band(s) 176 by the same second set gap 186 (e.g., which may be greater than 0.2 millimeters or about 0.5 millimeters). The first set gap 184 may be equal to the second set gap 186.

The relationship between the width 178, 180 of conductive bands 174, 176 and set gaps 184, 186 of conductive bands 174, 176 may further be defined. As an example, each conductive band 174 of the lower layer 170 may be defined at a common first horizontal width 178 (e.g., about 3 millimeters along the second direction). In some such embodiments, the first set gap 184 is between 10% and 30% of the first width 178. As an additional or alternative example, each conductive band 176 of the upper layer 172 may be defined at a common second horizontal width 180 (e.g., about 3 millimeters along the first direction). In some such embodiments, the second set gap 186 is between 10% and 30% of the second width 180.

Separate from or in addition to the spacing of conductive bands 174 and 176, each layer 170 and 172 may be arranged such that the corresponding conductive bands 174 or 176 are provided at a common horizontal pitch 188 or 190. Thus, the centerlines of adjacent conductive bands 174 or 176 are provided at the same horizontal distance (e.g., in the same direction as the conductive bands 174 or 176 are spaced apart from each other). In exemplary embodiments, the conductive bands 174 of the lower layer 170 are arranged at a common first horizontal pitch 188 (e.g., of about 3.5 millimeters). In additional or alternative embodiments, the conductive bands 176 of the upper layer 172 are arranged at a common second horizontal pitch 190 (e.g., of about 3.5 millimeters). Optionally, the first horizontal pitch 188 is equal to the second horizontal pitch 190.

Advantageously, the above described one-way field filter 160, including the described size and spacing of conductive bands 174 and 176, may permit an improved magnitude or measure of magnetic field 162 to pass (e.g., upward) therethrough to cooking chamber 104 while simultaneously preventing passage of microwaves 132 (e.g., downward) therethrough from cooking chamber 104 to induction heating coil 136, In certain embodiments, a heat resistant insulation layer 192 is sandwiched between the lower layer 170 and the upper layer 172 (e.g., along the vertical direction V). Thus, the lower layer 170 (and conductive bands 174 thereof) may be held on a bottom surface of insulation layer 192 while the upper layer 172 (and conductive bands 176 thereof) may be held on a top surface of insulation layer 192. In some such embodiments, insulation layer 192 includes or is formed from a mineral wool material. Optionally, the insulation layer 192 may define a vertical thickness 194 (e.g., constant thickness) between the layers 170 and 172 that is about 1 millimeter. Thus, lower and upper layers 170, 172 may be separated by about 1 millimeter of insulation layer 192.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance comprising:

a cabinet defining a cooking chamber;

a magnetron mounted within the cabinet in communication with the cooking chamber to direct a microwave thereto;

an induction heating coil mounted within the cabinet in communication with the cooking chamber to direct a magnetic field thereto; and a one-way field filter disposed within the cabinet between the induction heating coil and the cooking chamber to restrict passage of the microwave therethrough while permitting the magnetic field, the one-way filter comprising a lower layer comprising a plurality of parallel conductive bands extending in a first direction, the plurality of parallel conductive bands of the lower layer being spaced apart by a set first gap in a second direction perpendicular to the first direction, the first set gap being greater than 0.2 millimeters, and an upper layer disposed above the lower layer, the upper layer comprising a plurality of parallel conductive bands extending in the second direction, the plurality of conductive bands of the upper layer being spaced apart by a set second gap in the first direction, the second set gap being greater than 0.2 millimeters.

2. The cooking appliance of claim 1, wherein the one-way filter further comprises an insulation layer sandwiched between the lower layer and the upper layer.

3. The cooking appliance of claim 2, wherein the insulation layer comprises a mineral wool.

4. The cooking appliance of claim 2, wherein the insulation layer defines a vertical thickness between the lower layer and the upper layer, the vertical thickness being about 1 millimeter.

5. The cooking appliance of claim 1, further comprising a turntable assembly disposed within the cabinet, the turntable assembly comprising a rotatable platter positioned above the one-way field filter, and a drive rod extending from the rotatable platter through the one-way field filter.

6. The cooking appliance of claim 1, wherein each band of the plurality of parallel conductive bands of the lower layer defines a width of about 3 millimeters, and wherein each band of the plurality of parallel conductive bands of the upper layer defines a width of about 3 millimeters.

7. The cooking appliance of claim 1, wherein the plurality of parallel conductive bands of the lower layer are arranged at a first horizontal pitch of about 3.5 millimeters, and wherein the plurality of parallel conductive bands of the upper layer are arranged at a second horizontal pitch of about 3.5 millimeters.

8. The cooking appliance of claim 1, wherein the first set gap is about 0.5 millimeters, and wherein the second set gap is about 0.5 millimeters.

9. The cooking appliance of claim 1, further comprising an upper heater module mounted within the cabinet above the one-way filter field to direct a generated heat to the cooking chamber, the upper heater module comprising a resistive heating element or a radiant heating element.

10. The cooking appliance of claim 1, a convection module having one or more heating elements and a convection fan operable to move air within the cooking cavity.

11. A cooking appliance comprising:

a cabinet defining a cooking chamber;

a magnetron mounted within the cabinet in communication with the cooking chamber to direct a microwave thereto;

an induction heating coil mounted within the cabinet in communication with the cooking chamber to direct a magnetic field thereto; and a one-way field filter disposed within the cabinet between the induction heating coil and the cooking chamber to restrict passage of the microwave therethrough while permitting the magnetic field, the one-way filter comprising a lower layer comprising a plurality of parallel conductive bands extending in a first direction, the plurality of parallel conductive bands of the lower layer being spaced apart by a set first gap in a second direction perpendicular to the first direction, each band of the plurality of conductive bands of the lower layer defining a first width in the second direction, the set first gap being between 10% and 30% of the first width, and an upper layer disposed above the lower layer, the upper layer comprising a plurality of parallel conductive bands extending in the second direction, the plurality of conductive bands of the upper layer being spaced apart by a set second gap in the first direction, each band of the plurality of conductive bands of the upper layer defining a second width in the first direction, the set second gap being between 10% and 30% of the second width.

12. The cooking appliance of claim 11, wherein the one-way filter further comprises an insulation layer sandwiched between the lower layer and the upper layer.

13. The cooking appliance of claim 12, wherein the insulation layer comprises a mineral wool.

14. The cooking appliance of claim 12, wherein the insulation layer defines a vertical thickness between the lower layer and the upper layer, the vertical thickness being about 1 millimeter.

15. The cooking appliance of claim 11, further comprising a turntable assembly disposed within the cabinet, the turntable assembly comprising a rotatable platter positioned above the one-way field filter, and a drive rod extending from the rotatable platter through the one-way field filter.

16. The cooking appliance of claim 11, wherein each band of the plurality of parallel conductive bands of the lower layer defines a width of about 3 millimeters, and wherein each band of the plurality of parallel conductive bands of the upper layer defines a width of about 3 millimeters.

17. The cooking appliance of claim 11, wherein the plurality of parallel conductive bands of the lower layer are arranged at a first horizontal pitch of about 3.5 millimeters, and wherein the plurality of parallel conductive bands of the upper layer are arranged at a second horizontal pitch of about 3.5 millimeters.

18. The cooking appliance of claim 11, wherein the first set gap is about 0.5 millimeters, and wherein the second set gap is about 0.5 millimeters.

19. The cooking appliance of claim 11, further comprising an upper heater module mounted within the cabinet above the one-way filter field to direct a generated heat to the cooking chamber, the upper heater module comprising a resistive heating element or a radiant heating element.

20. The cooking appliance of claim 11, a convection module having one or more heating elements and a convection fan operable to move air within the cooking cavity.

* * * * *